US006039088A

United States Patent [19]

Stenhouse

[11] Patent Number: 6,039,088

[45] Date of Patent: Mar. 21, 2000

[54] REED ASSEMBLY WITH ANGLED DENTS

[75] Inventor: William L. Stenhouse, Greenville, S.C.

[73] Assignee: Steel Heddle Manufacturing Co., Greenville, S.C.

[21] Appl. No.: 09/164,529

[22] Filed: Sep. 30, 1998

[51] Int. Cl.[7] ..... D03D 49/62

[52] U.S. Cl. ..... 139/192; 139/26; 139/188 R

[58] Field of Search ..... 139/192, 188 R, 139/26

[56] References Cited

U.S. PATENT DOCUMENTS

| | | | |
|---|---|---|---|
| 1,686,448 | 10/1928 | Hargrove et al. . | |
| 2,914,094 | 11/1959 | Hutchins . | |
| 4,471,815 | 9/1984 | Wagner . | |
| 4,478,259 | 10/1984 | Honegger | 139/192 |
| 4,655,262 | 4/1987 | Scheffel et al. . | |
| 4,771,813 | 9/1988 | Gaisser . | |
| 4,989,646 | 2/1991 | Nitta et al. . | |
| 4,997,010 | 3/1991 | Stacher | 139/192 |
| 5,020,574 | 6/1991 | Van Bogaert et al. | 139/188 R |
| 5,415,205 | 5/1995 | Stenhouse . | |
| 5,479,965 | 1/1996 | Rydborn | 139/192 |
| 5,664,609 | 9/1997 | Herrlein et al. | 139/192 |

*Primary Examiner*—Andy Falik
*Attorney, Agent, or Firm*—Dority & Manning

[57] ABSTRACT

A slay and reed assembly for use on textile machines includes a reed having dents disposed in an upper and lower channel. A reciprocating motion slay with clamping device is used to carry the reeds and moves the reeds towards and away from a fabric fell line wherein the dents beat-up filler yarns into the fabric fell line. The clamping device includes a recess for receiving the lower channel of the reed. The recess has an essentially vertical front face that is at an angle of essentially 90° with the fabric fell line when the slay is in the beat-up position. The reed is received within the slay so that the dents are disposed to form an angle greater than 90° with respect to the fabric fell line when the slay is in the beat-up position and the vertical front face of the clamping device is perpendicular to the fabric fell line.

18 Claims, 3 Drawing Sheets

REED ASSEMBLY WITH ANGLED DENTS

BACKGROUND OF THE INVENTION

The present invention relates to an improved reed assembly for use in high speed weaving looms.

With most conventional slay and reed assemblies, the reed dents are presented to the fell line of the fabric at an angle that is generally perpendicular to the fell line or slightly acute with respect to the fell line. The reeds are formed by dents held in upper and lower channel members, with the lower channel member being set into a slay clamping device. At the beat-up position of the slay wherein the dents push a fill yarn against the fell line of the fabric, the dents and channel members are oriented essentially perpendicular to the fell line.

In certain applications, particularly in weaving terry cloth, certain weaves are better formed on weaving machines with the front or beat-up face of the reeds tilted backwards a predetermined degree away from the beat-up position. In other words, the longitudinal axis of the reed dents forms an angle of greater than 90° with respect to the fell line of the fabric. Standard reeds can be used in this application but the reed clamp in the driving slay must have a special design with the desired degree of tilt incorporated in the clamp. One such device having a slay clamp with a built-in angle or wedge of 4° is commercially available from Sulzer Ruti. However, the change from a normal clamp device to one having this built-in tilt or angle is costly and the retrofit is time consuming resulting in substantial downtime of the weaving machine.

The present invention relates to an improved reed assembly wherein the reeds are presented to the fell line at an angle greater than 90° without the necessity of changing the design of the slay clamping device.

OBJECTS AND SUMMARY OF THE INVENTION

It is thus a principal object of the present invention to provide an improved reed wherein it is possible to present the reed to the fell line of the fabric at an angle greater than 90° with use of standard slay clamping devices.

Additional objects and advantages of the invention will be set forth in part in the following description, or may be obvious from the description, or may be learned through practice of the invention.

In accordance with the objects and purposes of the invention, a slay and reed assembly is provided for a textile loom wherein the looms forms fabric by beating up filler yarns inserted into a shed formed between warp yarns into a fell line of the fabric being formed. The assembly includes a reed having an upper and lower channel and at least a first row of spaced apart adjacently disposed dents with ends thereof disposed in the upper and lower channels. The reed has a front beat-up side facing the fabric fell line. A reciprocating motion slay with a clamping device carries the reed so that the slay moves the reed towards and away from the fabric fell line wherein the dents beat the filler yarns into the fabric fell line. The clamping device comprises a recess configured therein for receiving the lower channel of the reed. The recess has an essentially vertical front face disposed on the side thereof towards the fabric fell line. This vertical front face of the clamping device defines an essentially perpendicular angle with respect to the fabric fell line in the beat-up position of the slay when the dents push the fill yarns into the fabric fell line. In the beat-up position, the reed is received in the clamping device recess so that the dents are disposed to form an angle of greater than 90° with respect to the fabric fell line.

In one preferred embodiment, the lower channel comprises a generally U-shaped member having a vertical front face disposed against the vertical front face of the clamping device recess, and wherein in the beat-up position of the slay, the front face of the lower channel is also essentially perpendicular to the fabric fell line. The dents are angularly disposed within the lower channel with respect to the front face of the channel so as to generate the angle of the dents greater than 90° with respect to the fabric fell line. In this embodiment, the lower channel may comprise a width that is greater than that of the dents, with the dents being angularly positioned within the greater width lower channel relative to the front face of the channel.

In an alternative embodiment, the lower channel may comprise an angled internal recess that is angled at the angle of greater than 90° with respect to the fabric fell line. The angled recess is defined by an angled inner front face of the lower channel and the dents are set against this angled front surface. In an alternative embodiment, the lower channel defines an essentially U-shaped member with vertical sides and the dents are angled within the channel and set in their angled position with an epoxy or other securing means.

The present inventive reed assembly is particularly useful in double dent reed assemblies used for weaving terry material. In this regard, the reed may comprise a second row of dents behind the first row of dents in a direction away from the fabric fell line. The first row of dents are angled at the angle of greater than 90° with respect to the fabric fell line in the beat-up position of the slay, and the second row of dents are essentially perpendicular to the fell line in the beat-up position.

With the present inventive configuration, the reeds can be used with conventional driving slays and slay clamps in the situations wherein the angled dents are desired without the expensive operation of changing out the slay or slay clamps.

The invention will described below in greater detail through use of the appended figures.

DETAILED DESCRIPTION

Reference will now be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For example, features illustrated or described as part of one embodiment can be used on another embodiment to yield still a further embodiment. It is intended that the present invention cover such modifications and variations as come within the scope of the appended claims and their equivalents.

Figure 1A:
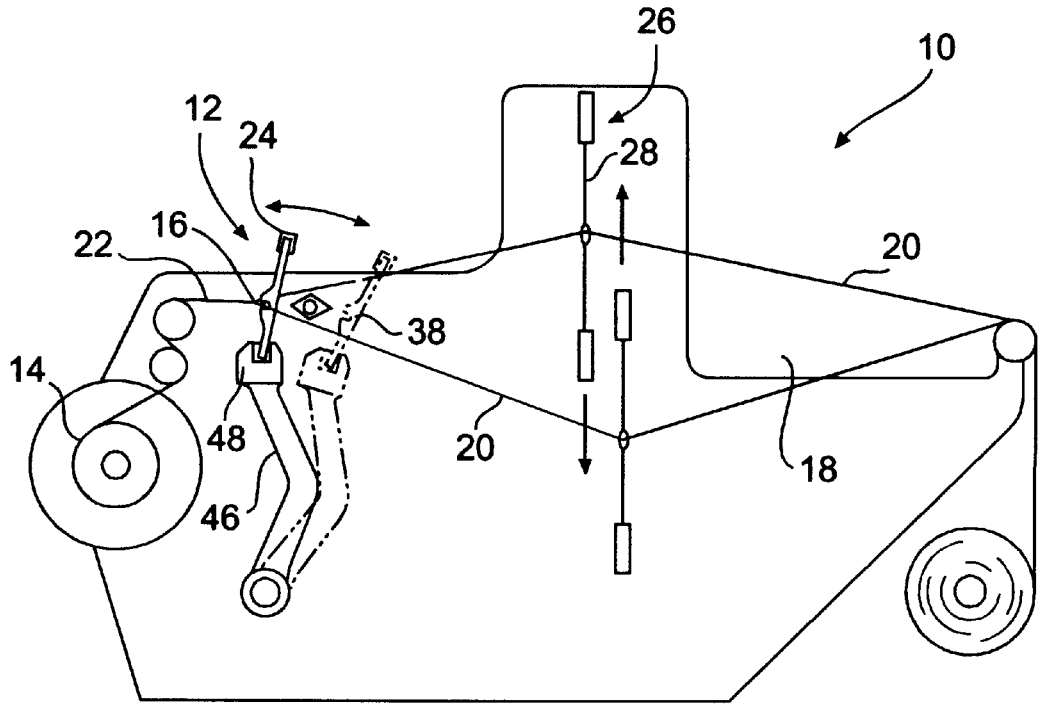
FIG. 1*a* is a diagrammatic operational view of a conventional loom.

FIG. 1*a* diagrammatically illustrates the basic operational components of a weaving loom and is provided for illustrative purposes. The operation of such looms is well understood by those skilled in the art and a detailed description thereof is not necessary for purposes of explaining the present invention. In general, loom 10 utilizes heddles 28 in heddle frames 26 to move warp yarns 20 in a reciprocating up and down motion to define a shed 18. A filling yarn 16 is passed through shed 18 by components not illustrated. Reeds 24 are mounted on a reciprocating slay 46 by means of a slay clamp 48. Slay 46 drives reeds 24 in a reciprocating back and forth motion as indicated by the arrow in FIG. 1*a* for beating up fill yarns 16 against a fell line 22 of a fabric 14 being produced. This operation is well understood by those skilled in the art.

The present invention relates to a reed that can be used with conventional driving slays and slay clamp devices yet which presents the dents at the beat-up position at angle of greater than 90° with respect to the fabric fell line. As briefly mentioned above, this presentation of the dents is desirable in certain weaving applications, particularly in weaving terry material.

Referring to the figures in general, with conventional devices, dents 38 are held in an upper channel 30 and lower channel 34. The channel members may be generally U-shaped with vertical sides. The dents 38 are conventionally held straight in the channels 30, 34, and the lower channel 34 is held in a clamp device 48 of a conventional driving slay 46. As briefly mentioned above, in most conventional weaving applications, reed 24 and, thus, dents 38, are presented to the fabric fell line 22 at a perpendicular angle when the slay is at its beat-up position.

One conventional device commercially available by Sulzer Ruti for presenting dents 38 to the fell line 22 at an angle greater than 90° utilizes a slay and slay clamp specifically designed for this purpose. With this conventional device, lower channel 34 of conventional reeds is inserted into an angled recess defined by a front angled face in the slay clamp. However, as mentioned above, this is an expensive and time consuming operation.

Figure 1B:
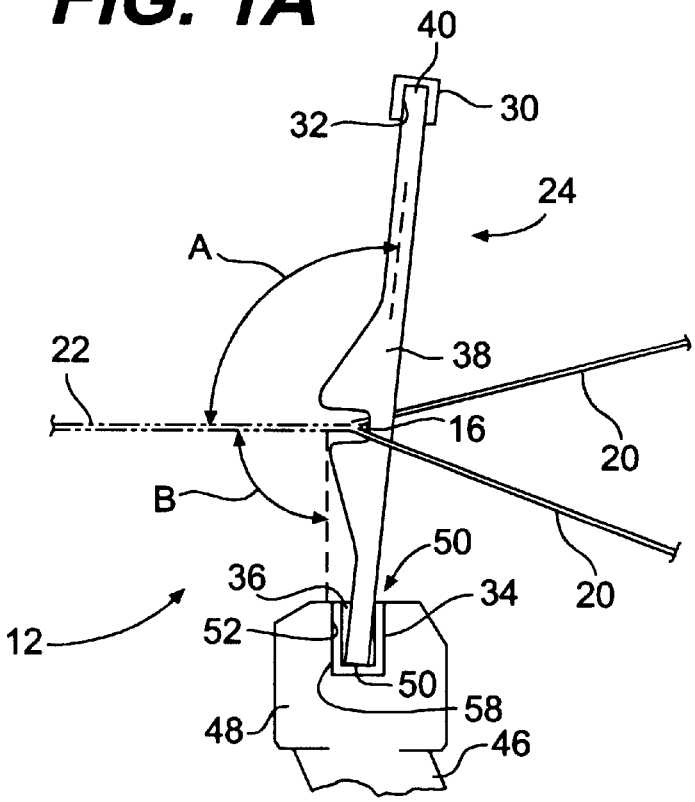
FIG. 1*b* is an enlarged operational view of the reed and slay assembly according to the invention at the beat-up position of the reed.

With the device according to the invention, conventional slays 46 and slay clamps 48 can be utilized that have an essentially vertical front face 52 for receiving lower channel 34 of reed 24. Referring particularly to FIG. 1*b*, angle A is the angle formed between dent 38 and fell line 22 of the fabric in the beat-up position of slay 46 and clamp 48. Here it can be seen that front vertical face 52 defining the recess in clamp 48 for receipt of lower channel 34 is perpendicular, as indicated by angle B with respect to fell line 22. Lower channel 34 has a front vertical face 58 that lies directly against face 52 and, thus, is also perpendicular to fell line 22. Lower channel 34 defines an internal recess or space 36 for receipt of the lower end 50 of dents 38 in a manner so that the dents 38 are presented at angle A with respect to fell line 22 resulting in their being non parallel to the face 58.

Figure 4:
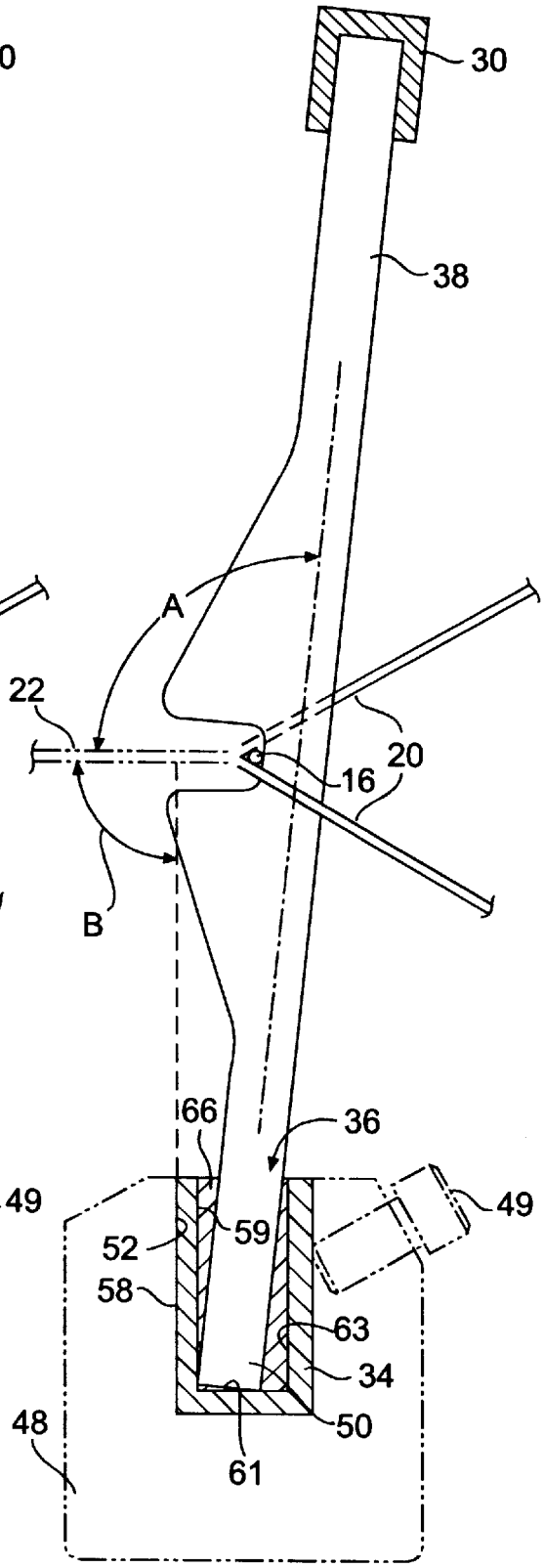
FIG. 4 is a view similar to FIG. 3 of an alternative embodiment of the reed.

One particular embodiment is illustrated in FIG. 4. In this embodiment, clamp 48 is a conventional clamp design for receipt of conventional reeds. Clamp 48 has a vertical front face 52 against which front face 58 of lower channel 34 abuts. FIG. 4 shows the slay and clamp in the beat-up position wherein dents 38 are pushing fill yarn 16 into fell line 22. In this beat-up position, angle B between the plane of faces 52 and 58 is perpendicular with respect to fell line 22. However, angle A between the longitudinal axis of dent 38 and fell line 22 is greater than 90°. To accomplish this angle, dents 38 are disposed at an angle with respect to inside front face 59 of lower channel 34. The inner width of channel 34 is greater than the width of end section 50 of dent 38 to accommodate the angled position of the dent. It may be preferred that the inner channel width is defined between inner front face 59 and inner back face 63 an exact amount to produce the desired angle when dents 38 are pulled rearward within channel 34 so that the front lower edge of dent 38 abuts against face 59 and the back edge abuts against face 63 generally at the top of channel 34, as illustrated in FIG. 4. Dent 38 is held in this angled position within channel 34 by means of epoxy 66 or other securing adhesives or devices.

Lower channel 34 is held in clamp 48 by any conventional means, such as bolt 49. It should be understood, however, that any conventional slay, clamp, or securing devices are within the scope and spirit of the invention and it is a specific purpose of the invention to use the reeds according to the invention in any conventional driving slay and clamp mechanism.

Figure 3:
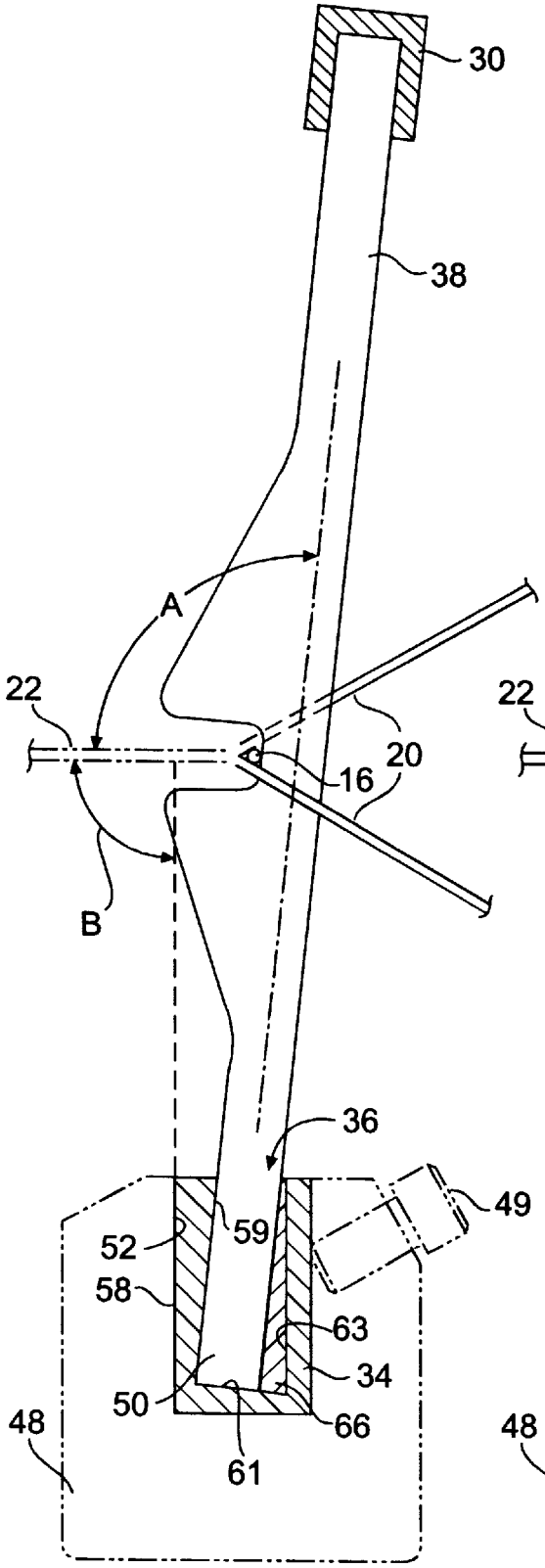
FIG. 3 is an enlarged perspective operational view of a reed according to the invention at its beat-up position.

FIG. 3 illustrates an alternative embodiment similar to FIG. 4 with the exception that front inner face 59 of lower channel 34 is angled with respect to front vertical faces 52 and 58. Bottom surface 61 is also angled with respect to a horizontal plane. In this embodiment, the front edge of dent lower portion 50 abuts directly against angled inside face 59 and angled bottom surface 61. The back edge of dent 38 abuts directly against the top of inside back surface 63 of lower channel 34. Thus, the angle of dent 38 within channel 34 is precisely established by the degree of slope or angle of inside front surface 59. Adhesive or epoxy 66 may be used to set end 50 of dent 38 within lower channel 34.

As briefly mentioned above, the present inventive reeds are particularly useful in weaving terry material. When weaving such material, double dent reeds are also particularly useful. One embodiment of such a double dent reed is disclosed in U.S. Pat. No. 5,415,205 commonly owned by the present assignee Steel Heddle Manufacturing Company of Greenville, S.C. The '205 patent is incorporated herein by reference for all purposes.

Figure 2:
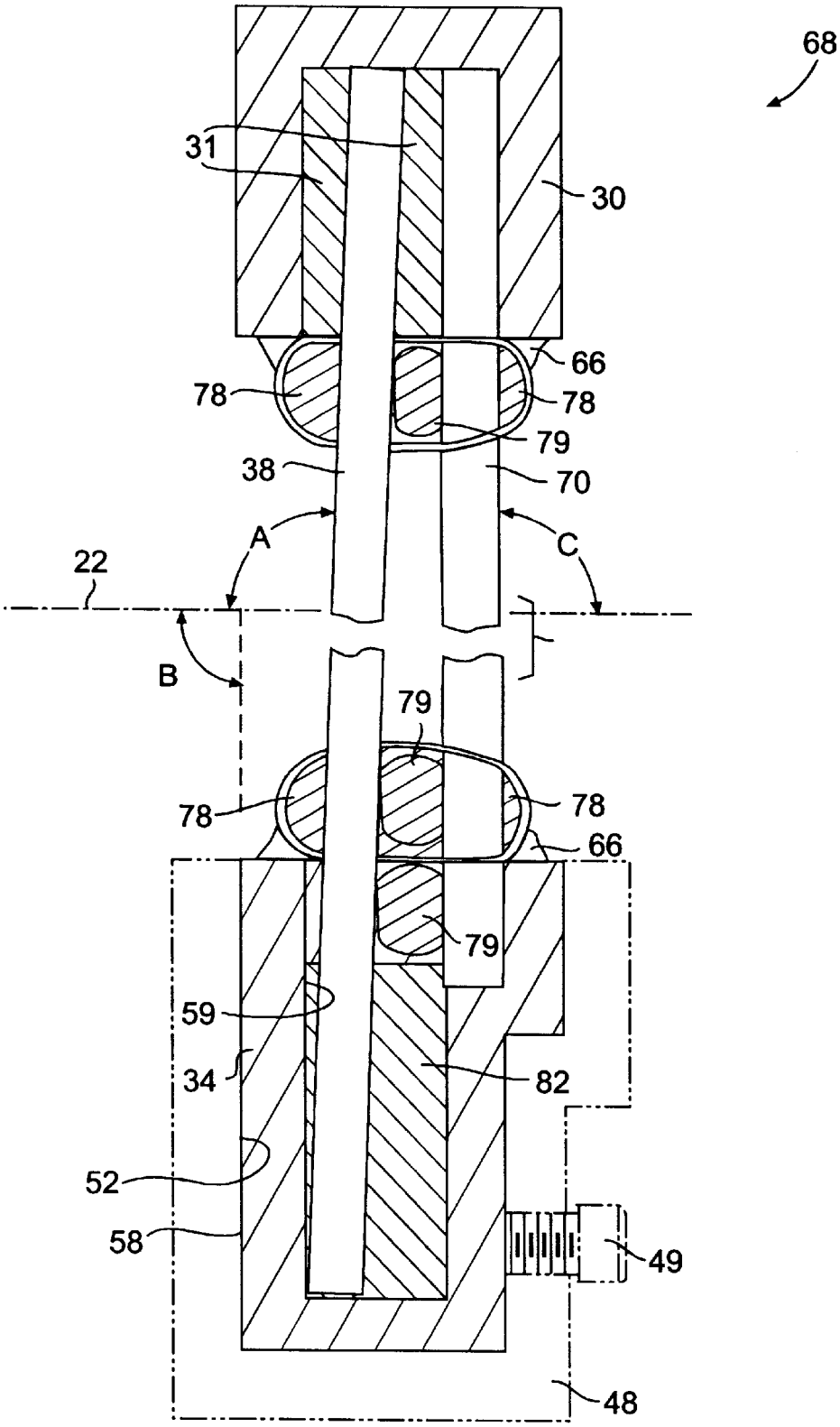
FIG. 2 is a cross-sectional view of a double dent reed assembly according to the invention.

The double dent reed 68 illustrated in FIG. 2 is similar to the double dent reed construction of the '205 patent with the exception that the front row of dents 38 are angled at an angle A greater than 90° with respect to fell line 22. The back row of dents 70 is perpendicular to fell line 22, as indicated by angle C, at the beat-up position of the double dent slay and clamp 48. Upper channel 30 has an internal recess to accommodate both rows of dents 38, 70. The upper portions of dents 38 and 70 are set within channel 30 with any conventional filler, such as bars, rods, adhesives, and the like. Flat sided spacer rods 78, 79 and epoxy 66 may also be used with the dents and upper channel 30 as illustrated, to structurally support and maintain the spacing between the dents.

Lower channel 34 includes a front vertical face 58 disposed directly against the front vertical face of clamp 48, as with the previously discussed embodiments. Lower channel 34 includes a vertical inner face 59. First row of dents 38 are angularly disposed within lower channel 34 as discussed above with reference to FIG. 4. Dents 38 may also be disposed against an angled inner surface 58, as discussed above with regards to FIG. 3. A filler or spacer bar 82 or other material may be used to set the position of first dent 38 within channel 34. The construction, operation, and use of the remaining portions of the double dent reed 68 illustrated in FIG. 2 are as described in the '205 patent, which is incorporated herein by reference.

The present invention also relates to a textile machine for weaving fabric incorporating the inventive reed as discussed herein.

Similarly, the present invention also relates to the inventive reed itself, as discussed herein, for use with any conventional textile machine and slay/slay clamp assembly.

It should be apparent to those skilled in the art that various modifications and variations can be made in the present invention without departing from the scope and spirit of the invention. It is intended that the present invention include such modifications and variations as come within the scope of the appended claims and their equivalents.

What is claimed is:

1. A slay and reed assembly for a textile loom that forms fabric by beating up filler yarns inserted into a shed formed between warp yarns into a fell line of the fabric, said assembly comprising:

a reed, said reed further comprising an upper channel and a lower channel, and at least a first row of spaced apart adjacently disposed dents with ends thereof disposed in said upper and lower channels, said reed having a front beat up side facing the fabric fell line;

a reciprocating motion slay with a clamping device, said reed carried by said clamping device so that said slay moves said reed towards and away from the fabric fell line wherein said dents beat up filler yarns into the fabric fell line;

said clamping device comprising a recess configured for receiving said lower channel, said recess having an essentially vertical front face towards the fabric fell line; and wherein when said reed is received in said recess, said dents are disposed so as to be non-parallel to said vertical front face of said clamping device and to form an angle of greater than ninety degrees with respect to the fabric fell line when said vertical front face of said clamping device recess is essentially perpendicular to the fabric fell line in a beat up position of said slay.

2. A slay and reed assembly for a textile loom that forms fabric by beating up filler yarns inserted into a shed formed between warp yarns into a fell line of the fabric, said assembly comprising:

a reed, said reed further comprising an upper channel and a lower channel, and at least a first row of spaced apart adjacently disposed dents with ends thereof disposed in said upper and lower channels, said reed having a front beat up side facing the fabric fell line;

a reciprocating motion slay with a clamping device, said reed carried by said clamping device so that said slay moves said reed towards and away from the fabric fell line wherein said dents beat up filler yarns into the fabric fell line;

said clamping device comprising a recess configured for receiving said lower channel, said recess having an essentially vertical front face towards the fabric fell line;

wherein when said reed is received in said recess, said dents are disposed so as to form an angle of greater than ninety degrees with respect to the fabric fell line when said vertical front face of said clamping device recess is essentially perpendicular to the fabric fell line in a beat up position of said slay; and wherein said lower channel comprises a generally U-shaped member with a front face disposed against said vertical front face of said clamping device recess, and wherein in said beat up position of said slay, said front face of said lower channel is also essentially perpendicular to the fabric fell line, and wherein said dents are angularly disposed within said lower channel with respect to said front face so as to generate said angle of said dents greater than ninety degrees with respect to the fabric fell line.

3. The assembly as in claim 2, wherein said lower channel comprises a width greater than that of said dents, said dents angularly positioned within said greater width lower channel.

4. The assembly as in claim 2, wherein said lower channel comprises an angled internal recess, said dents received within said angled recess thereby causing said dents to angled at said angle greater than ninety degrees with respect to the fabric fell line in said beat up position of said slay.

5. The assembly as in claim 4, wherein said angled recess is defined by an angled inner front surface of said lower channel.

6. A slay and reed assembly for a textile loom that forms fabric by beating up filler yarns inserted into a shed formed between warp yarns into a fell line of the fabric, said assembly comprising:

a reed, said reed further comprising an upper channel and a lower channel, and at least a first row of spaced apart adjacently disposed dents with ends thereof disposed in said upper and lower channels, said reed having a front beat up side facing the fabric fell line;

a reciprocating motion slay with a clamping device, said reed carried by said clamping device so that said slay moves said reed towards and away from the fabric fell line wherein said dents beat up filler yarns into the fabric fell line;

said clamping device comprising a recess configured for receiving said lower channel, said recess having an essentially vertical front face towards the fabric fell line;

wherein when said reed is received in said recess, said dents are disposed so as to form an angle of greater than ninety degrees with respect to the fabric fell line when said vertical front face of said clamping device recess is essentially perpendicular to the fabric fell line in a beat up position of said slay; and wherein said reed is a double dent reed and comprises a second row of dents behind said first row of dents in a direction away from the fabric fell line.

7. The assembly as in claim 6, wherein said first row of dents are angled with respect to said second row of dents.

8. The assembly as in claim 7, wherein when said slay is at said beat up position and said vertical front face of said clamping device recess is essentially perpendicular to the fabric fell line, said second row of dents is also essentially perpendicular to the fabric fell line.

9. A textile machine for weaving fabric by beating up fill threads against a fell line of the fabric between a shed defined between warp threads, comprising:

a reed, said reed further comprising an upper channel and a lower channel, and at least a first row of spaced apart adjacently disposed dents with ends thereof disposed in said upper and lower channels, said reed having a front beat up side facing the fabric fell line;

a reciprocating motion slay with a clamping device, said reed carried by said clamping device so that said slay moves said reed towards and away from the fabric fell line wherein said reeds beat up filler yarns into the fabric fell line;

said clamping device comprising a recess configured for receiving said lower channel, said recess having an essentially vertical front face towards the fabric fell line; and wherein when said reed is received in said recess, said dents are disposed so as to be non-parallel to said vertical front face of said clamping device and to form an angle of greater than ninety degrees with respect to the fabric fell line when said vertical front face of said clamping device recess is essentially perpendicular to the fabric fell line in a beat up position of said slay.

10. A textile machine for weaving fabric by beating up fill threads against a fell line of the fabric between a shed defined between warp threads, comprising:

a reed, said reed further comprising an upper channel and a lower channel, and at least a first row of spaced apart adjacently disposed dents with ends thereof disposed in said upper and lower channels, said reed having a front beat up side facing the fabric fell line;

a reciprocating motion slay with a clamping device, said reed carried by said clamping device so that said slay moves said reed towards and away from the fabric fell line wherein said reeds beat up filler yarns into the fabric fell line;

said clamping device comprising a recess configured for receiving said lower channel, said recess having an essentially vertical front face towards the fabric fell line;

wherein when said reed is received in said recess, said dents are disposed so as to form an angle of greater than ninety degrees with respect to the fabric fell line when said vertical front face of said clamping device recess is essentially perpendicular to the fabric fell line in a beat up position of said slay; and wherein said lower channel comprises a generally U-shaped member with a front face disposed against said vertical front face of said clamping device recess, and wherein in said beat up position of said slay, said front face of said channel is also essentially perpendicular to the fabric fell line, and wherein said dents are angularly disposed within said lower channel with respect to said front face so as to generate said angle of said dents greater than ninety degrees with respect to the fabric fell line.

11. The machine as in claim 10, wherein said lower channel comprises a width greater than that of said dents, said dents angularly positioned within said greater width lower channel at an angle of greater than zero degrees with respect to said front face.

12. A textile machine for weaving fabric by beating up fill threads against a fell line of the fabric between a shed defined between warp threads, comprising:

a reed, said reed further comprising an upper channel and a lower channel, and at least a first row of spaced apart adjacently disposed dents with ends thereof disposed in said upper and lower channels, said reed having a front beat up side facing the fabric fell line;

a reciprocating motion slay with a clamping device, said reed carried by said clamping device so that said slay moves said reed towards and away from the fabric fell line wherein said reeds beat up filler yarns into the fabric fell line;

said clamping device comprising a recess configured for receiving said lower channel, said recess having an essentially vertical front face towards the fabric fell line;

wherein when said reed is received in said recess, said dents are disposed so as to form an angle of greater than ninety degrees with respect to the fabric fell line when said vertical front face of said clamping device recess is essentially perpendicular to the fabric fell line in a beat up position of said slay; and wherein said lower channel comprises a generally U-shaped member with a front outer face disposed against said vertical front face of said clamping device recess, and a front inner face angled at said angle of greater than ninety degrees with respect to the fabric fell line when said slay is in said beat up position and said vertical front face of said clamping device recess is essentially perpendicular to the fabric fell line in a beat up position of said slay, said dents set against said angled front inner face thereby causing said dents to angled at said angle greater than ninety degrees with respect to the fabric fell line in said beat up position of said slay.

13. A textile machine for weaving fabric by beating up fill threads against a fell line of the fabric between a shed defined between warp threads, comprising:

a reed, said reed further comprising an upper channel and a lower channel, and at least a first row of spaced apart adjacently disposed dents with ends thereof disposed in said upper and lower channels, said reed having a front beat up side facing the fabric fell line;

a reciprocating motion slay with a clamping device, said reed carried by said clamping device so that said slay moves said reed towards and away from the fabric fell line wherein said reeds beat up filler yarns into the fabric fell line;

said clamping device comprising a recess configured for receiving said lower channel, said recess having an essentially vertical front face towards the fabric fell line;

wherein when said reed is received in said recess, said dents are disposed so as to form an angle of greater than ninety degrees with respect to the fabric fell line when said vertical front face of said clamping device recess is essentially perpendicular to the fabric fell line in a beat up position of said slay; and wherein said reed is a double dent reed and comprises a second row of dents behind said first row of dents in a direction away from the fabric fell line.

14. The machine as in claim 13, wherein said first row of dents are angled with respect to said second row of dents.

15. The machine as in claim 14, wherein when said slay is at said beat up position and said vertical front face of said clamping device recess is essentially perpendicular to the fabric fell line, said second row of dents is also essentially perpendicular to the fabric fell line.

16. A reed for use in a textile machine that weaves fabric with said reed carried in a reciprocating motion slay by beating up filler yarns inserted into a shed formed between warp yarns into a fell line of the fabric, said reed comprising:

an upper channel and a lower channel, and at least a first row of spaced apart adjacently disposed dents with ends thereof disposed in said upper and lower channels, said reed and dents having a front beat up side facing the fabric fell line;

said lower channel comprising a generally U-shaped member with a front face configured for being disposed against a vertical front face of a clamping device recess in the slay; and said dents disposed within said lower channel with said beat up sides thereof at an angle greater than zero degrees with respect to said front face of said channel so that when said front face of said channel is essentially perpendicular to the fabric fell line, said dents are at an angle of greater than ninety degrees with respect to the fabric fell line.

17. The reed as in claim 16, wherein said lower channel comprises a width greater than that of said dents, said dents angularly positioned within said greater width lower channel at said angle of greater than zero degrees.

18. A reed for use in a textile machine that weaves fabric with said reed carried in a reciprocating motion slay by beating up filler yarns inserted into a shed formed between warp yarns into a fell line of the fabric, said reed comprising:

an upper channel and a lower channel, and at least a first row of spaced apart adjacently disposed dents with ends thereof disposed in said upper and lower channels, said reed and dents having a front beat up side facing the fabric fell line;

said lower channel comprising a generally U-shaped member with a front face configured for being disposed against a vertical front face of a clamping device recess in the slay; and said lower channel front face defining an angle of less than ninety degrees with respect to a horizontal line therethrough so that said dents are at an angle of greater than ninety degrees with respect to the fabric fell line in a beat up position of the slay.

* * * * *